US012011631B2

(12) United States Patent
Hughes

(10) Patent No.: US 12,011,631 B2
(45) Date of Patent: Jun. 18, 2024

(54) FITNESS DEVICE

(71) Applicant: FLO FITNESS LLC, San Diego, CA (US)

(72) Inventor: Chrisman Hughes, San Diego, CA (US)

( * ) Notice: Subject to any disclaimer, the term of this patent is extended or adjusted under 35 U.S.C. 154(b) by 0 days.

(21) Appl. No.: 17/697,650

(22) Filed: Mar. 17, 2022

(65) Prior Publication Data

US 2023/0293928 A1 Sep. 21, 2023

(51) Int. Cl.

| | |
|---|---|
| ***A63B 21/02*** | (2006.01) |
| ***A63B 21/00*** | (2006.01) |
| ***A63B 21/04*** | (2006.01) |
| ***A63B 21/055*** | (2006.01) |
| ***A63B 23/035*** | (2006.01) |

(52) U.S. Cl.

CPC .. *A63B 21/00043* (2013.01); *A63B 21/00185* (2013.01); *A63B 21/02* (2013.01); *A63B 21/0442* (2013.01); *A63B 21/0552* (2013.01); *A63B 21/0555* (2013.01); *A63B 23/03516* (2013.01)

(58) Field of Classification Search

CPC ..... A63B 21/00043; A63B 21/0442; A63B 21/00185; A63B 21/002; A63B 21/0023; A63B 21/0552; A63B 21/0555; A63B 21/0557; A63B 23/03516; A63B 21/02; A63B 21/04; A63B 21/4033; A63B 21/065; A63B 2023/006; A63B 23/035; A63B 23/03575; A63B 21/4034; A63B 21/4035; A63B 2071/009; A63B 2209/00; A63B 2209/14; A63B 2225/09

See application file for complete search history.

(56) References Cited

U.S. PATENT DOCUMENTS

| | | | | |
|---|---|---|---|---|
| 5,569,136 | A * | 10/1996 | Holten | A63B 21/00043 482/126 |
| 7,955,236 | B2 * | 6/2011 | DiGiovanni | A63B 21/0552 482/129 |
| D678,434 | S | 3/2013 | Hughes | |
| 9,050,484 | B2 | 6/2015 | Flentye et al. | |
| 9,486,663 | B2 * | 11/2016 | DeMarco | A63B 21/16 |
| 10,682,540 | B2 | 6/2020 | Manitone | |
| 10,857,425 | B2 | 12/2020 | Thomas | |
| 11,167,164 | B2 | 11/2021 | Landis | |
| 2018/0093123 | A1 * | 4/2018 | Williams | A63B 23/03508 |

FOREIGN PATENT DOCUMENTS

AU 2021103236 A4 7/2021

* cited by examiner

*Primary Examiner* — Megan Anderson

(74) *Attorney, Agent, or Firm* — Reilly Intellectual Property Law Firm

(57) ABSTRACT

The fitness device comprising dual retaining members in engagement with a tension member.

17 Claims, 6 Drawing Sheets

FITNESS DEVICE

The current device relates to an exercise device and more particularly to a device utilizing retaining members in engagement with a tension member.

BACKGROUND

The current device relates to the general field of exercise equipment and more specifically to a device having first and second retaining members located at terminal ends of straps that include a static portion and a flexible portion. This allows for iso-kinetic and iso-metric stretching and strength training to improve muscle strength, tone, size, and flexibility.

The present device allows for stretching, iso-metrics, iso-tonic, iso-kinetic and iso-motion. Simplified definitions are offered not by limitation and are as follows:

- stretching—simple muscle elongation positions, many of which can be associated with Yoga or Pilates;
- iso-metrics—where no muscular movement (Static) takes place while the muscles are under resistance;
- iso-tonic—the repetitive motion of certain movements with resistance;
- iso-kinetic—constant and continuous resistance level through the complete range of movement; and
- iso-motion—the muscles under load with varying resistance through any range of movement (Dynamic).

The current device offers full control of the resistance with an immediate muscle response and further offers a yielding iso-metric exercise device that eases joints into mobility and slight resistance. The current device provides yielding tension and disperses the load for joint health. The device also performs as an indicator of user engagement.

The device does not depend upon gravity and provides more mobility options and joint angles than a typical exercise device. Due to the fact that the user creates the resistance, there is available constant time under tension and fatigue response resulting in resistance adaptation. As a user fatigues, muscles adapt with resistance. The device provides iso-kinetic as well as iso-tonic exercise options with constant core engagement and progressive resistance. Strength training occurs as a result of the inelastic band or static webbing that allows for loading and creation of added resistance. By creating tension and holding a position on a given joint angle, iso-metrics take place. Once the user moves through various joint angles while maintaining tension, iso-motion takes place. As a result, the device allows for stretching and strength training options through use of resistance providing for a full range of motion exercises. Further, while resistance band exercise devices are convenient and easily transportable, the elastic bands do not allow for an iso-kinetic resistance in extending the band and have a limited resistance range based on the strength of the band.

In the current device, the user provides almost all of the resistance thus it is very difficult to be injured as one's muscles provide the force and as they tire, so the force used will decrease in stark contrast to lifting a fixed heavy load that cannot vary in resistance during the exercise.

SUMMARY

The present device allows "iso" related exercises (Iso-metric, Iso-tonic, Iso-Motion, Iso-kinetic) allowing the user to combine a variable resistance factor as the body moves through full joint rotation, thereby never placing the user under a greater physical load than the body can tolerate. This self-imposed push/pull resistance level greatly reduces the chance of exercise injury due to excessive resistance levels.

The present device allows users to improve strength, agility, balance, flexibility, mobility, and coordination in addition to many muscular rehabilitative movements. These exercises can be isolated to a single muscular area or involve whole body movements combining major muscle groups and multiple joint movements together.

There is provided a fitness device for performing resistance exercises, comprising at least one inelastic strap, that may be semi-continuous or continuous, having a tension member located at terminal ends of the at least one strap; and retaining members engaging opposite ends of the tension member. The at least one strap includes at least one stop member and a length forming at least one retaining member. The tension member comprises at least one elastic member, at least one inelastic member overlaying the at least one elastic member and the tension member is joined to the retaining members with at least one stop member. The fitness device also includes a sleeve member enclosing a majority of the tension member and the retaining members may comprise removable and non-removable grips or at least one semi-circular plate. The strap, the retaining member and the at least one stop member form a single point of resistance for the tension member.

DRAWINGS

DETAILED DESCRIPTION

Figure 1:
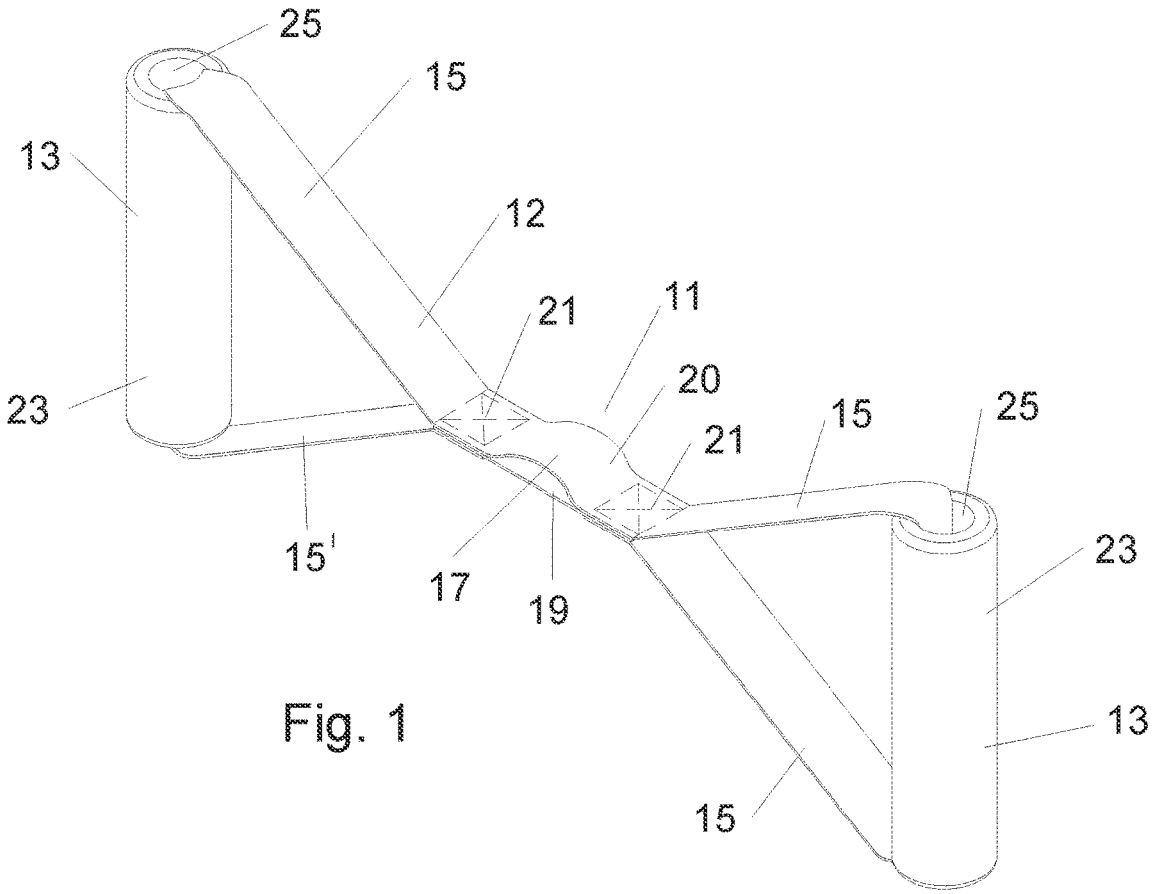
FIG. 1 is a perspective view of the FITNESS DEVICE.
Figure 2:
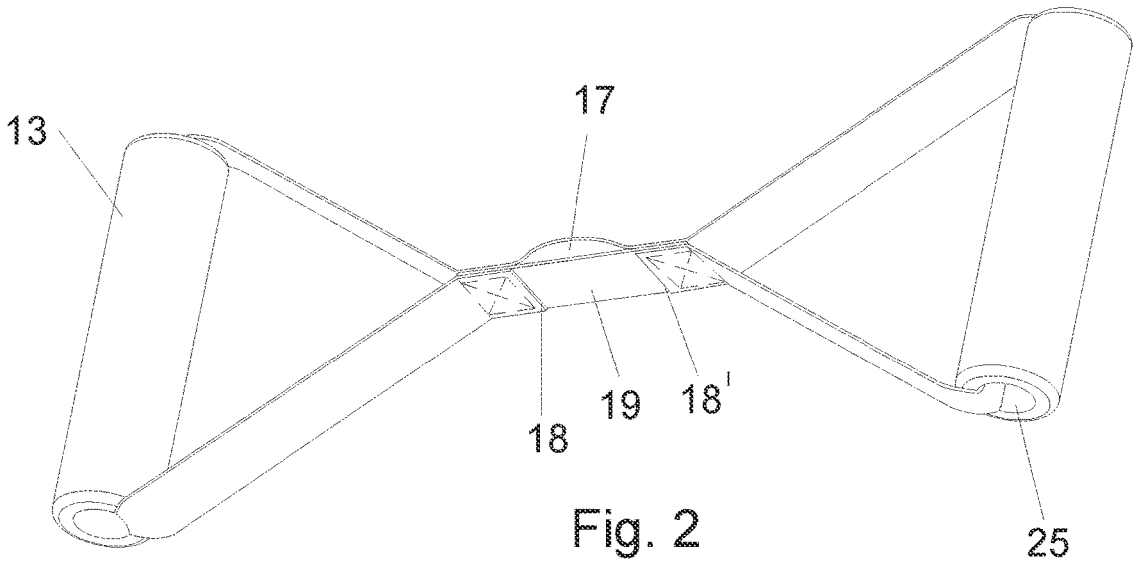
FIG. 2 is an alternate perspective view of FIG. 1.
Figure 3:
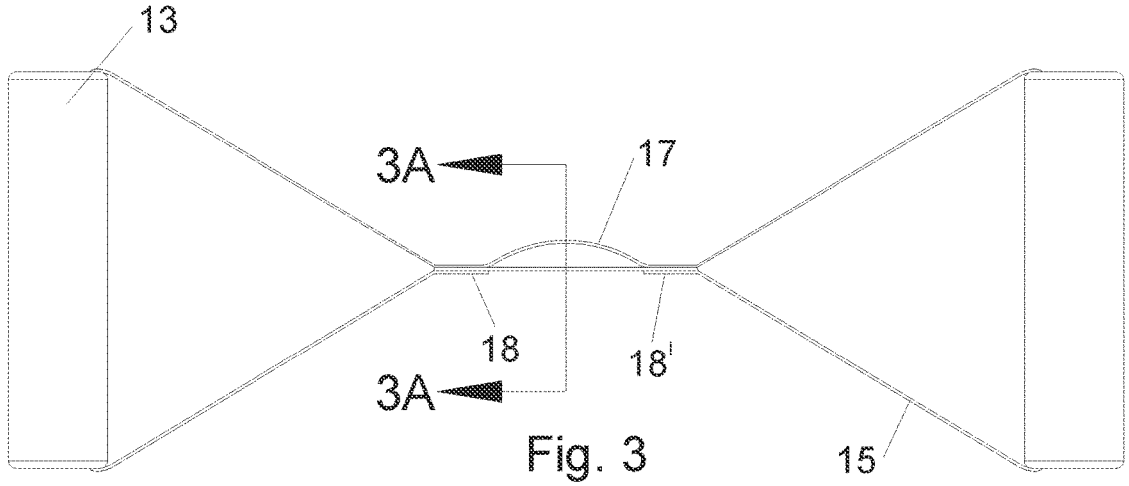
FIG. 3 is a front view of FIG. 1.
Figure 3A:
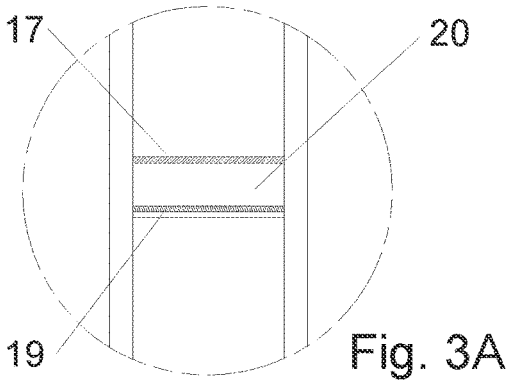
FIG. 3A is a cross-sectional view about lines 3A-3A of FIG. 3.
Figure 4A:
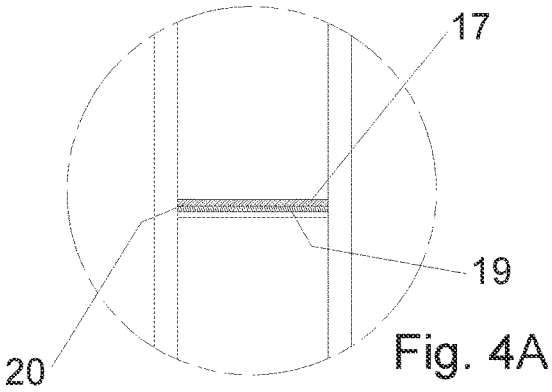
FIG. 4A is a cross-sectional view about lines 4A-4A of FIG. 4.
Figure 4:
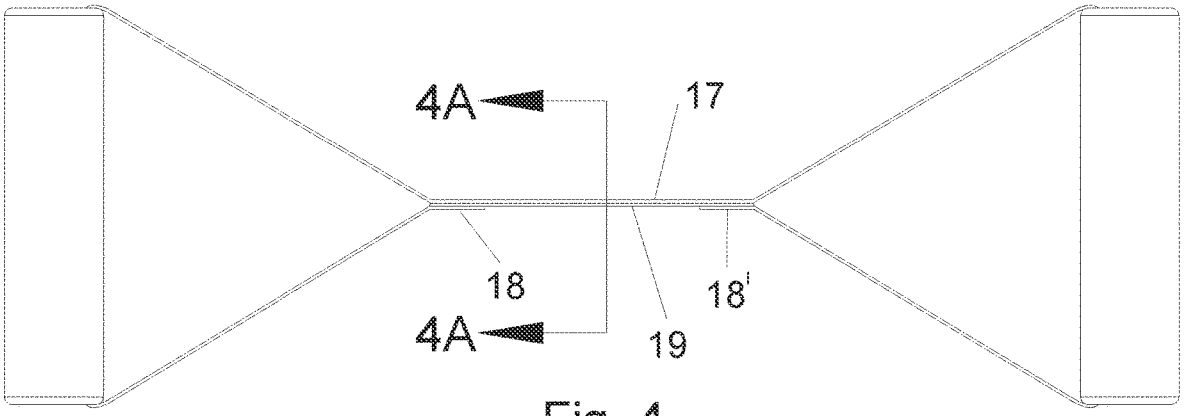
FIG. 4 is a front view of FIG. 1 shown in an extended configuration.

There is provided a device and method of exercise as broadly shown in FIGS. 1-11.

More specifically, the device 11 shown in FIGS. 1-4 broadly comprises dual retaining members 13 engaging with and located at opposite ends of a resistance member 12 comprising at least one continuous inelastic strap 15, 15', static member 17, base elastic member 19 and stop members 21. A tension system 20 is formed with the combination of the static member 17 overlaying the base elastic member 19, to be discussed in more detail. The strap 15, 15' is preferably a single strap, having a length, measured from the retaining member 13 mid-point to the stop members 21, between 4 inches and 6 inches in one form. The strap is non-elastic or inelastic and preferably composed of webbing made from nylon, polypropylene, polyester, Gore-Tex, neoprene, cotton or any other type of material that may be woven. A rope or plastic material may also be used.

In one form, the inelastic strap 15, 15' is a continuous or semi-continuous strap having a length of approximately 36 inches with a range of 26 inches to 80 inches, and including buckles for adjusting the length without departing from the scope of the disclosure. Terminal ends 18, 18' are inserted through dual inner tubes 25, forming semi-triangular loops at opposite ends with the terminal ends 18, 18' engaging stop members 21. A mid-portion of the strap 15 forms the static member 17 which is part of the tension system 20. As mentioned above, the strap 15, 15' may be inserted through the inner tube 25 made up of durable semi-rigid plastic with two open ends and an outer tube or grip 23 covering the exterior of the inner tube and constructed of foam rubber, soft plastic material, glass filled nylon plastic or any other type of gripping material. Preferably, the retaining member has a length in the range of 5 inches to 5.5 inches with a diameter of approximately 1 inch although smaller and larger dimensions are also contemplated. It is also contemplated that the retaining member includes a grip of one-piece construction (not shown).

Figure 5:
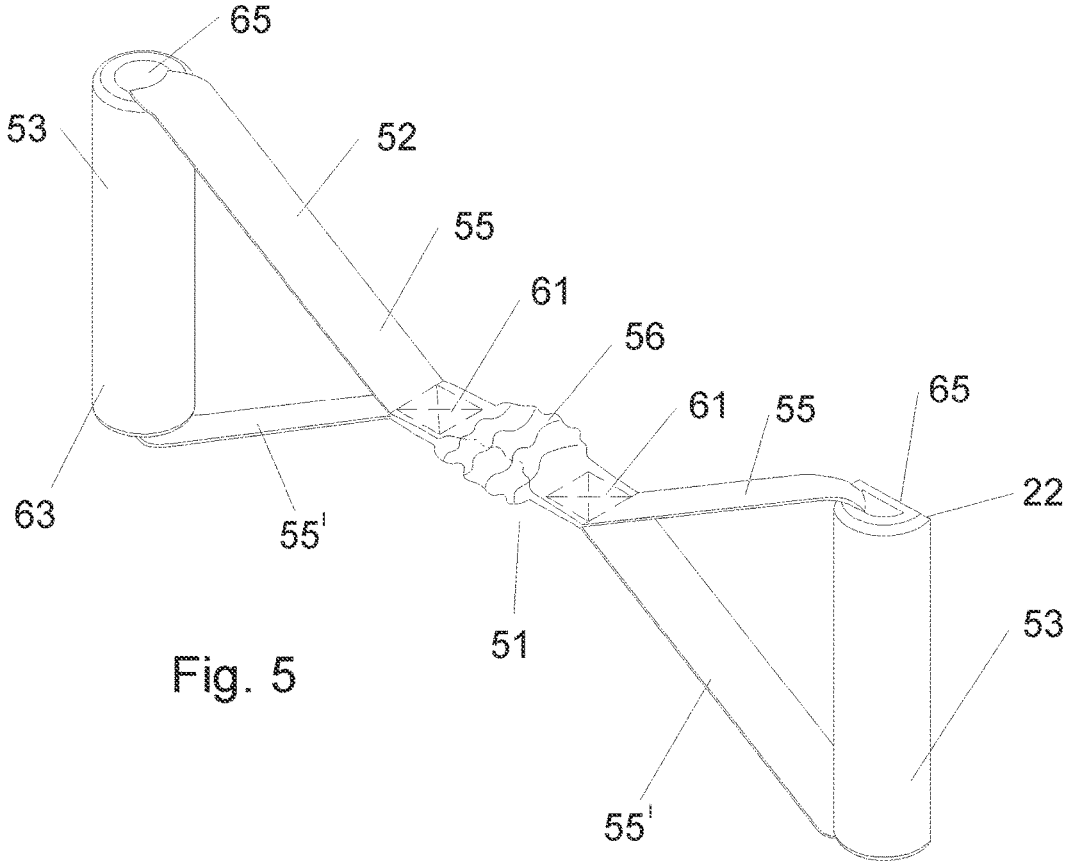
FIG. 5 is a perspective view of an alternate form of FITNESS DEVICE with a modified handle.
Figure 6:
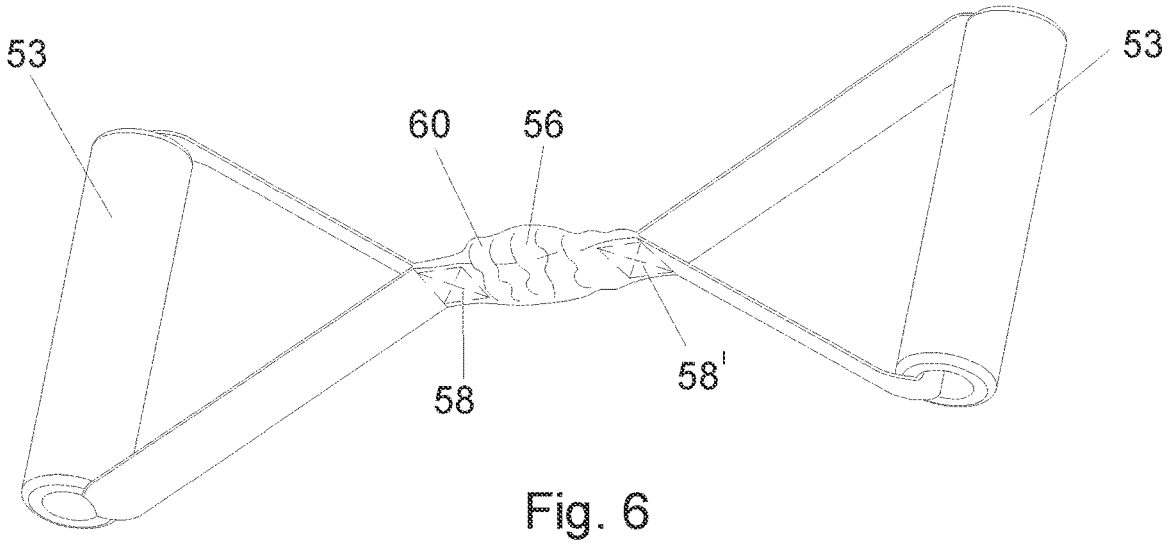
FIG. 6 is an alternate perspective view of FIG. 5 without the modified handle.
Figure 7:
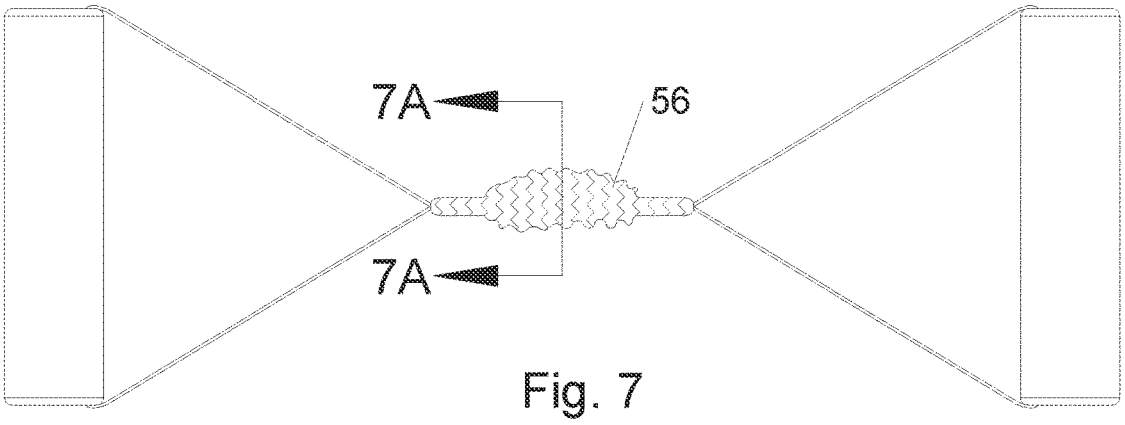
FIG. 7 is a front view of FIG. 6.
Figure 7A:
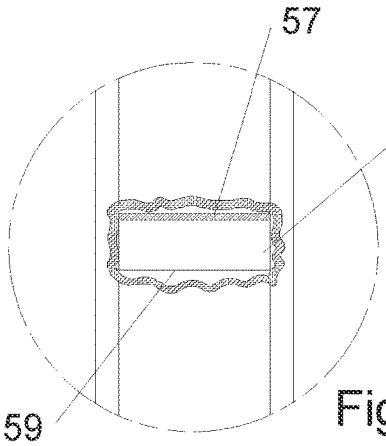
FIG. 7A is a cross-sectional view about lines 7A-7A of FIG. 7.
Figure 8A:
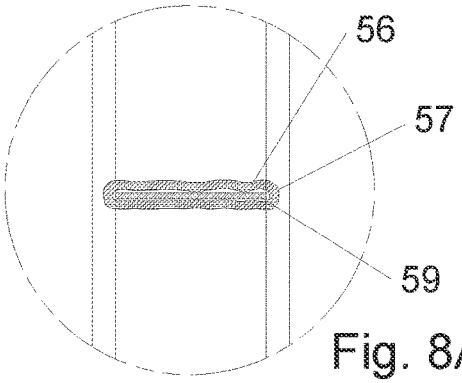
FIG. 8A is a cross-sectional view about lines 8A-8A of FIG. 8; a FIG. 9 is front view of the FITNESS DEVICE shown in FIG. 1 in use.
Figure 8:
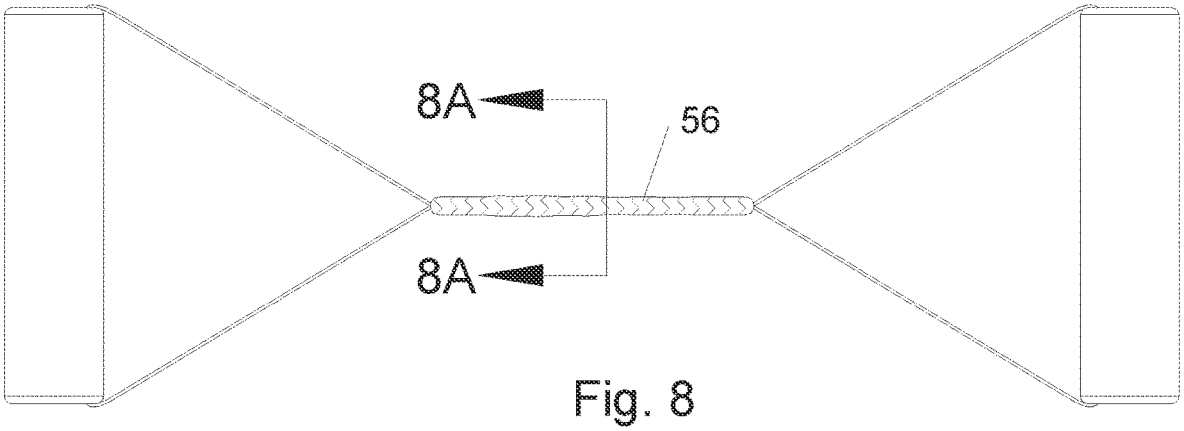
FIG. 8 is a front view of FIG. 6 shown in an extended configuration.

In the current form, the inner tube 25 with the grip 23 may be rotated to the side of the strap so that a user may use with a different hand position or the strap alone for retaining or gripping a hand, foot, ankle or the like. The grip 23 may also be modified to make it removable at the user's option (not shown). The retaining members 13 may also be formed from the strap 15, 15' forming a continuous loop with a reinforced plate or a half-cylinder with a flat side 22 as shown in FIG. 5. It is also contemplated that the retaining member have a flat plate or member for cradling a foot or ankle. Further, a retaining member with a grip may be formed at one end with a modified form of retaining member having the half-cylinder at an opposite end as shown in FIG. 5 (not shown).

The tension member 20 is engaged with the retaining members at opposite ends and comprises the static member 17 measuring in the range of 1.25 inches to 6.0 inches but preferably 2.5 inches and the base elastic member 19, measuring in the range of 0.25 inches to 5.0 inches with a preferable measurement of 1.5 inches in a relaxed state. The static member 17 overlays the base elastic member 19 forming a stop stretch. The base elastic member or yielding member 19 has a controlled stretch and is stretched to the length of the static member 17. This protects the elastic member from overloading and breaking. In this manner, a pulling force exerted by the retaining members results in an opposing force when the tension member 20 is stretched to the static member 17 capacity. The retaining member with dual straps engaging at a single point with the tension member forming a triangular resistance point provides dispersal of the load and creates a point of tension at the tension member for even resistance whereby the tension member is adapted to impart resistance to the user. See FIGS. 2-4A.

The length of the elastic member is preferably about 60% of the length of the static member. The elastic member may have load bearing resistance between 0.5 lbs. and up to 100 lbs. of load bearing strength or elasticity strength and will depend upon the user's desired resistance. As an example, but not by way of limitation, the device 11 will have a length of 12.5 inches in a relaxed state. When a pulling force is exerted on both retaining members 13, the length of the device 11 expands to approximately 14.5 inches. In another form, the length of the device could be expanded to up to 60 inches for alternate uses that will be discussed in more detail. The stop members 21 engage the terminal ends 18, 18' of the strap 15, 15' as well as the terminal ends of the static member 17 and the base elastic member 19, securing them in any suitable manner such as by stitching, heat sealing or gluing and the like. The handle strap 15, 15' forms a triangular configuration that terminates in the stop member 21. The stop member 21 is made up of stitching that securely attaches a joining point 18, 18' between the handle strap 15, 15' and the tension member 17 and the base elastic member 19. This allows the user to exert a pulling force on the tension member and receive 0.5 to 100 pounds of resistance, depending upon the elastic strength, before the load is placed on the woven strap which can tolerate up to thousands of pounds of tension.

There is also provided an alternate form of device shown in FIGS. 5-8A. More specifically, the device 51 broadly comprises dual retaining members 53 engaging with and located at opposite ends of a resistance member 52 comprising at least one continuous inelastic strap 55, 55', static member 57, base elastic member 59 and stop members 61. A tension system 60 is formed with the combination of the static member 57 overlaying the base elastic member 59 and sleeve member 56, to be discussed in more detail. The straps 55, 55' each have a length, measured from the retaining member 53 mid-point to the stop members 61, between 4 inches and 6 inches in one form. The strap is non-elastic or inelastic and preferably composed of webbing made from nylon, polypropylene, polyester, Gore-Tex, neoprene, cotton or any other type of material that may be woven. A rope or plastic material may also be used.

In one form, the inelastic strap 55, 55' is a continuous strap having a length of approximately 36 inches with a range of 26 inches to 80 inches without departing from the scope of the disclosure. Terminal ends 58, 58' are inserted through dual inner tubes 65, forming semi-triangular loops at opposite ends with the terminal ends 58, 58' engaging stop members 61. A mid-portion of the strap 55 forms the static member 57 which is part of the tension system 60. As mentioned above, the strap 55, 55' may be inserted through the inner tube 65 made up of durable semi-rigid plastic with two open ends and an outer tube or grip 53 covering the exterior of the inner tube and constructed of foam rubber, soft plastic material, glass filled nylon plastic or any other type of gripping material. The retaining member may also form a grip of one-piece construction (not shown). Preferably, the retaining member has a length in the range of 5 inches to 5.5 inches with a diameter of approximately 1 inch although smaller and larger dimensions are also contemplated. The grip 53 may also be modified to make it removable at the user's option (not shown).

The retaining members 53 may also be formed from the strap 55, 55' forming a continuous loop with a reinforced plate or a half-cylinder with a flat side 22 as shown in FIG. 5. Further, a retaining member with a grip may be formed at one end with a modified form of retaining member having the half-cylinder at an opposite end as shown in FIG. 5 or the inner tube 65 and grip 63 may be pushed to the side so that the strap alone may be used.

The tension member 60 is engaged with the retaining members at opposite ends and comprises the static member 57 measuring in the range of 2.25 inches to 3.0 inches but preferably 2.5 inches and the base elastic member 59, measuring in the range of 1.25 inches to 5.0 inches with a preferable measurement of 1.5 inches in a relaxed state. The static member 57 overlays the base elastic member 59 forming a stop stretch. The base elastic member 59 has a controlled stretch and is stretched to the length of the static member 57. In this manner, a pulling force exerted by the retaining members results in an opposing force when the tension member 60 is stretched to the static member 57 capacity. The tension member is covered by the sleeve member 56 which is made up any type of stretchable, woven material or tension fabric. The sleeve member 56 provides 0.5 inches to 5 inches of slack and then the load will be transferred from the elastic 59 to the sleeve member 56. The sleeve member 56 provides a covering for the tension member so that it is more aesthetically pleasing but it also takes on the load of resistance preventing overloading of the elastic as well as the user's joints.

As an example, but not by way of limitation, the device 51 will have a length of 12.5 inches in a relaxed state, with a range of 8 inches to 60 inches. When a pulling force is exerted on both retaining members 53, the length of the device 51 expands to approximately 14.5 inches. In another form, the length of the device could be expanded to up to 60 inches for alternate uses including placement of a foot in one retaining member and placement of a hand in the opposite retaining member. The stop members 61 engage the terminal ends 58, 58' of the strap 55, 55' as well as the terminal ends of the static member 57 and the base elastic member 59, securing them in any suitable manner such as by stitching, heat sealing or gluing and the like with the sleeve member 56.

Figure 9:
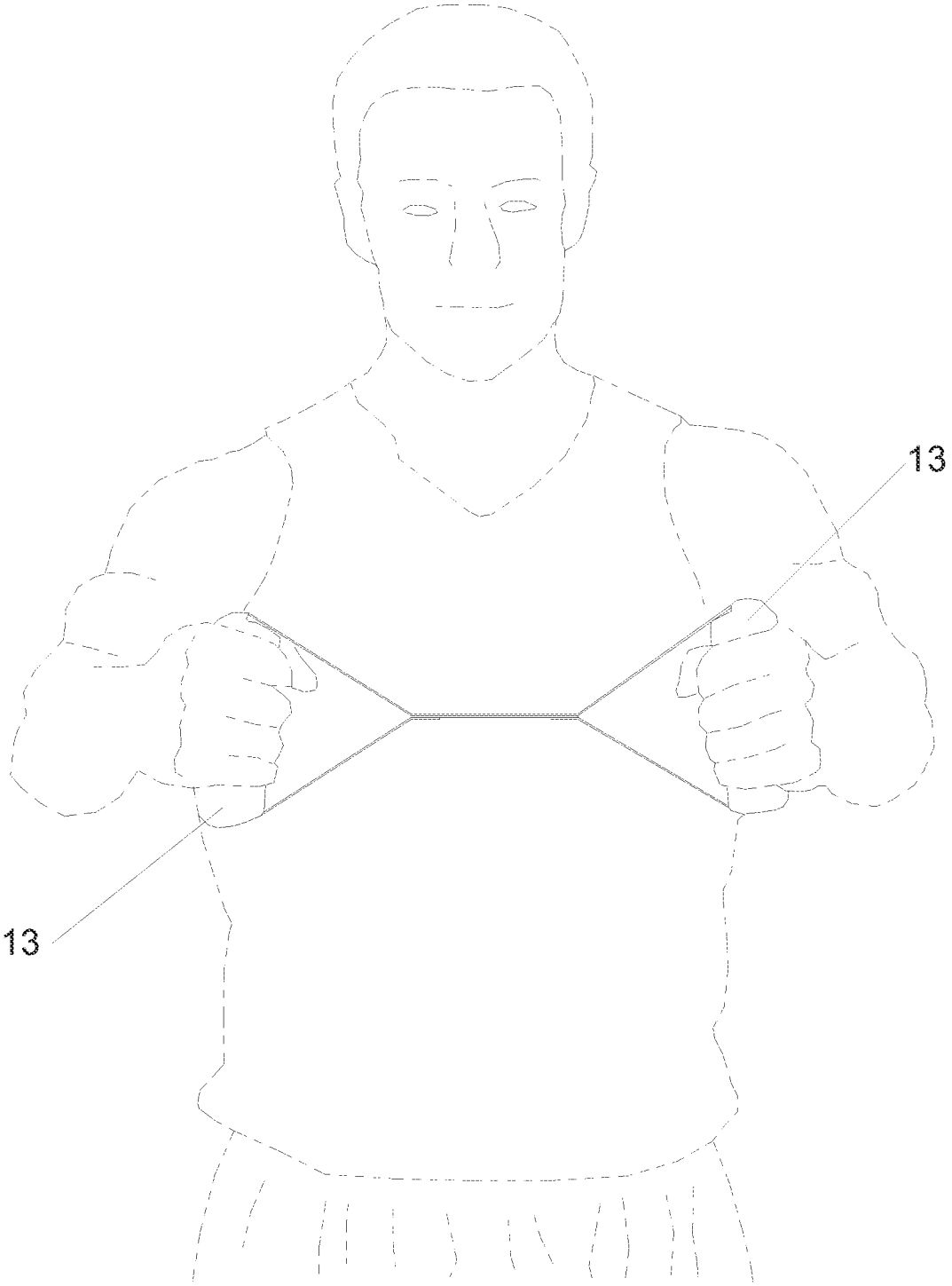
Figure 10:
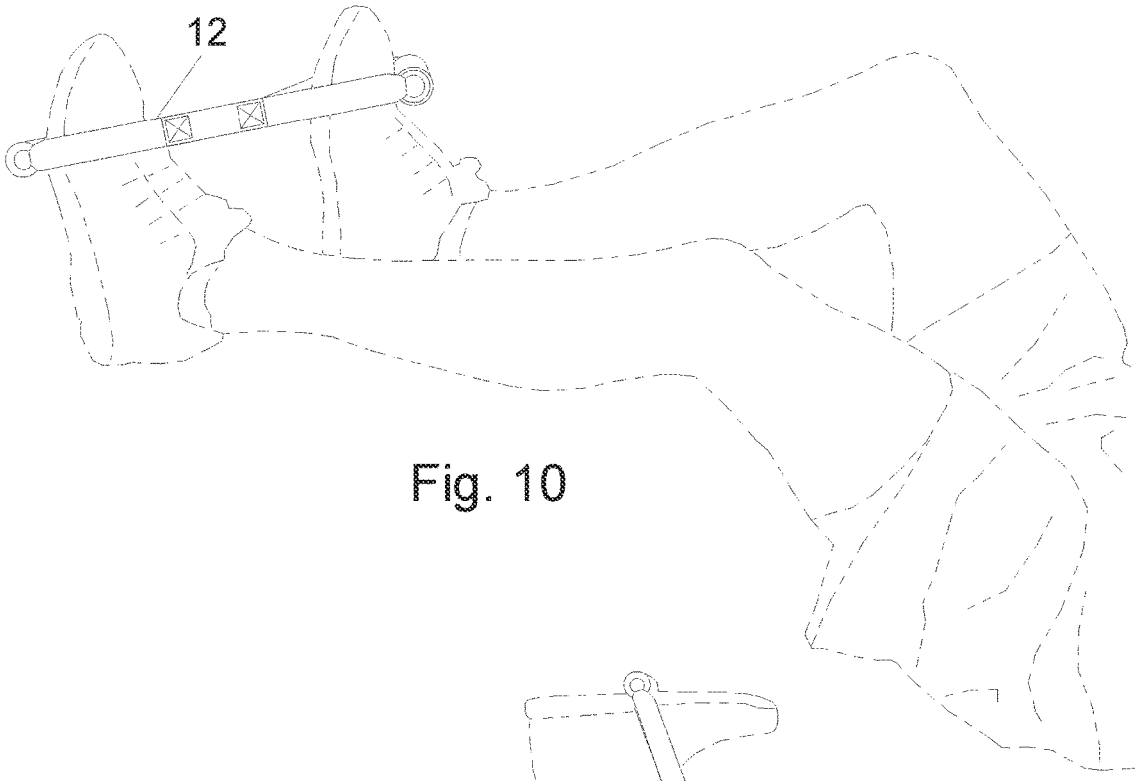
FIG. 10 is a partial view of the device of FIG. 1 shown in use.
Figure 11:
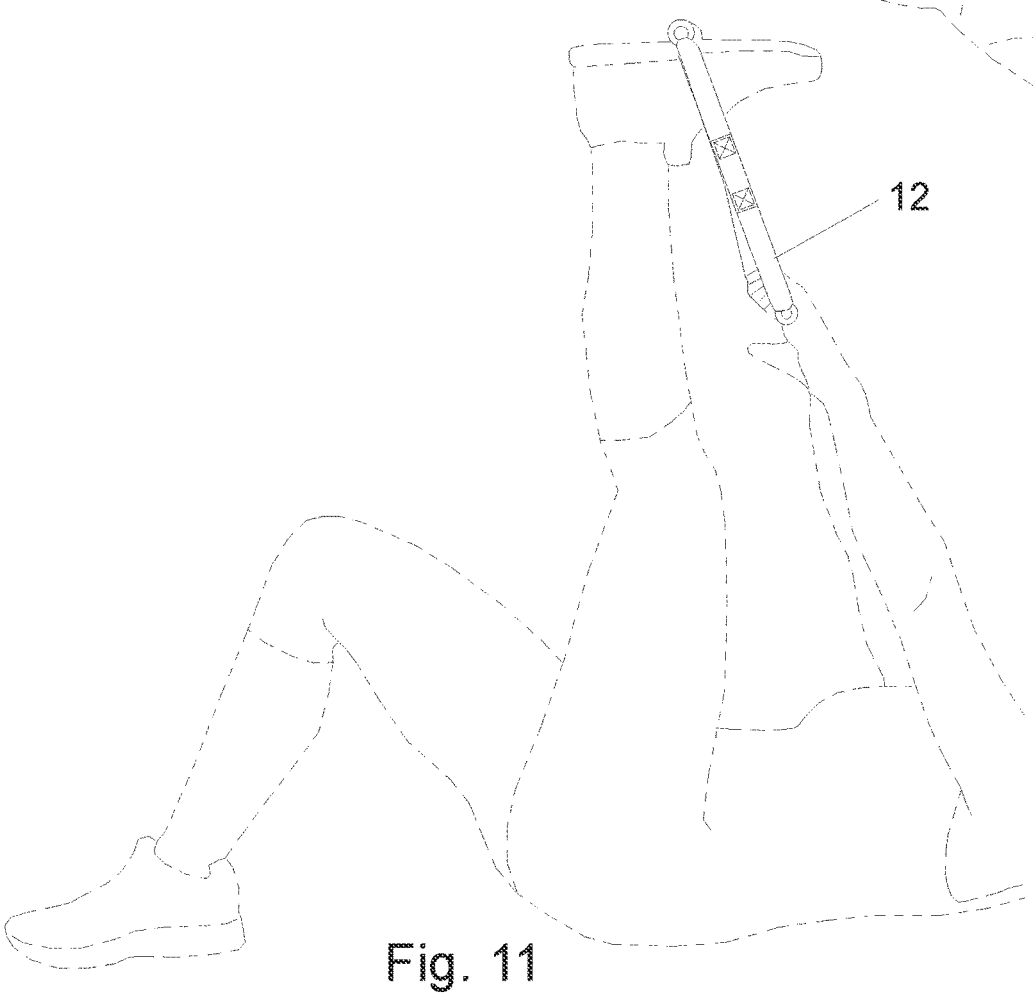
FIG. 11 is a partial view of the device of FIG. 1 shown in use.

In use, the device is adapted to provide a method of performing resistance exercises. The device 12, 51 is placed between two anchor points, generally a pair of hands, or a pair of legs or ankles, or one hand and one leg or ankle, or an anchor point such as a post or door frame/door combination and one hand or one leg or ankle. Reference is made to FIGS. 9-11.

A user may place one foot or ankle in a retaining member and a hand in the opposite retaining member to provide stretching and strength training. In this form, a longer strap may be desired of up to 48 inches. Both of the user's feet may also be placed in each retaining member for stretching and strength training. It may also be used as a body weight device by placing the retaining member around a post or in-between a door and door frame. The other retaining member is placed over the feet/ankle or hands of a user. Iso-metric, iso-motion, and the aforementioned iso-related exercises can be used in combination with bodyweight resistance. This results in restricted area movement of the resistance members when performing certain iso-metric and iso-motion exercises.

With reference to FIG. 9, a user is shown in one of a multitude of exercise positions aiding in stretching, strength and flexibility. A user is shown gripping the retainer members 13 with the user's hands and the tension member at full extension with the device at chest height and elbows slightly bent, moving side to side laterally to work the lateral posterior deltoid. FIG. 11 shows a user with the retainer member 12 gripped with the user's hand and the opposite retainer member 12 placed on a user's foot. The user will lie back and pull their foot towards their head with a slight bend in the knee to work the hamstring, calf and lower back. FIG. 1110 shows a user with the retainer members 13 placed on both feet. The user will keep the top foot bent at the knee and bring their thigh to chest and back down to work the hip flexor, psoas and core.

The foregoing description has been presented for purposes of illustration and description. It is not intended to be exhaustive nor to limit the method and system to the precise forms disclosed. Many alternatives, modifications, and variations will be apparent to those skilled in the art in light of the above. Accordingly, the device disclosed is intended to embrace all alternatives, modifications, and variations that fall within the spirit and broad scope of the claims.

I claim:

1. A fitness device for performing resistance exercises, comprising:

at least one inelastic strap having a tension member located at terminal ends of said at least one inelastic strap; said at least one inelastic strap having stop members non-releasably secured to said terminal ends of said at least one inelastic strap and said tension member; and retaining members engaging opposite ends of said at least one inelastic strap.

2. The fitness device according to claim 1 wherein said tension member comprises at least one elastic member.

3. The fitness device according to claim 2 wherein said tension member includes said at least one inelastic member overlaying said at least one elastic member.

4. The fitness device according to claim 1 wherein said at least one inelastic strap has a length forming said retaining members.

5. The fitness device according to claim 1 wherein said tension member is joined to said retaining members by said stop members.

6. The fitness device according to claim 1 wherein a sleeve member encloses a majority of said tension member.

7. The fitness device according to claim 1 wherein said retaining members comprise removable and non-removable grips.

8. The fitness device according to claim 1 wherein said retaining members are defined by at least one semi-circular plate.

9. The fitness device according to claim 1 wherein said at least one inelastic strap is continuous.

10. The fitness device according to claim 1 wherein said retaining members and said stop members form at least one triangular form.

11. A portable fitness device combining elastic and inelastic members, comprising:

at least one inelastic strap forming a continuous double loop;

a tension member located at terminal ends of said at least one inelastic strap, said tension member comprising a static member overlaying an elastic member;

said at least one inelastic strap having stop members non-releasably secured to said terminal ends of said at least one inelastic strap and said tension member; and retaining members at opposite ends of said continuous loop.

12. The portable fitness device according to claim 11 wherein said tension member includes a sleeve member.

13. The portable fitness device according to claim 11 wherein said retaining members form a triangle with said tension member.

14. The portable fitness device according to claim 11 wherein said tension member is adapted to impart resistance to the user.

15. The portable fitness device according to claim 11 wherein said tension member is joined to said retaining members with said stop members.

16. The portable fitness device according to claim 11 wherein a length of said static member is greater than a length of said elastic member.

17. A method of exercise using a combination of an inelastic strap, non-releasable stop members and a yielding member with two retaining members, the method comprising:

securing one of said retaining members to the hand or foot of a user;

securing a second of said retaining members to the hand or foot of a user or a stationary member;

stretching said at least one retaining member in an outward direction;

holding said at least one retaining member in a stretched position;

exerting force against said inelastic strap and said stop members thereby generating resistance; and releasing said stretch.

* * * * *